US010012473B2

(12) United States Patent
Munsell et al.

(10) Patent No.: US 10,012,473 B2
(45) Date of Patent: Jul. 3, 2018

(54) SHOOTING SPORTS SIGHT APPARATUS

(71) Applicant: HAMSKEA ARCHERY SOLUTIONS LLC, Johnstown, CO (US)

(72) Inventors: Andrew W. Munsell, Brighton, CO (US); Frank Grochocki, Broomfield, CO (US)

(73) Assignee: Hamskea Archery Solutions LLC, Johnstown, CO (US)

( * ) Notice: Subject to any disclaimer, the term of this patent is extended or adjusted under 35 U.S.C. 154(b) by 0 days.

(21) Appl. No.: 15/840,962

(22) Filed: Dec. 13, 2017

(65) Prior Publication Data

US 2018/0112950 A1 Apr. 26, 2018

Related U.S. Application Data

(63) Continuation-in-part of application No. 15/079,076, filed on Mar. 24, 2016.

(60) Provisional application No. 62/142,680, filed on Apr. 3, 2015.

(51) Int. Cl.

| | |
|---|---|
| ***F41G 1/467*** | (2006.01) |
| ***F41G 1/01*** | (2006.01) |
| ***F41B 5/14*** | (2006.01) |
| *F41G 11/00* | (2006.01) |

(52) U.S. Cl.

CPC ..... *F41G 1/467* (2013.01); *F41B 5/1419* (2013.01); *F41G 1/01* (2013.01); *F41G 11/00* (2013.01)

(58) Field of Classification Search

CPC . F41G 11/00; F41G 1/467; F41G 1/01; F41B 5/1419

USPC ..... 33/265; 124/87; D22/107; 42/119–133

See application file for complete search history.

(56) References Cited

U.S. PATENT DOCUMENTS

| | | | | |
|---|---|---|---|---|
| 605,982 A | | 6/1898 | Miller | |
| 697,357 A | | 4/1902 | Peak | |
| 2,083,934 A | | 6/1937 | Arden | |
| 2,125,932 A | | 8/1938 | Lennon | |
| 2,814,284 A | * | 11/1957 | Sileo | F41B 5/12 124/25 |
| 2,842,114 A | * | 7/1958 | Duncan | F41B 5/12 124/25 |
| 3,431,652 A | | 3/1969 | Leatherwood | |
| 3,703,770 A | | 11/1972 | Sofield | |

(Continued)

*Primary Examiner* — R. A. Smith
*Assistant Examiner* — Tania Courson
(74) *Attorney, Agent, or Firm* — Trenner Law Firm, LLC; Mark D. Trenner

(57) ABSTRACT

A shooting sports sight apparatus to inhibit unwanted stray light of an observable scene. An example apparatus comprises a sight housing having a first end, a second end, an outer surface, and an inner surface. At least one concentric ring is positioned between the first end and the second end. At least one annular groove is defined between the first end of the sight housing and the concentric ring. The concentric ring provides a surface for stray light photons entering the first end of the sight housing to bounce in directions generally away from the line of sight into the annular groove, thereby inhibiting the stray light photons from entering field of regard (FOR) photons reaching the aft end of the sight housing which make up the observable scene where the second end has means for changing the baffle aperture diameter forming the final light baffle of the baffle assembly.

19 Claims, 12 Drawing Sheets

(56) References Cited

U.S. PATENT DOCUMENTS 3,703,771 A 11/1972 Saunders
3,859,733 A 1/1975 Chesnick
3,922,795 A * 12/1975 Bettencourt ..... F41G 1/08 33/265
4,011,853 A 3/1977 Fletcher
4,217,026 A 8/1980 Radovich
4,375,725 A 3/1983 Orlob
4,395,096 A 7/1983 Gibson
4,542,963 A 9/1985 Linlor
4,552,121 A 11/1985 Treaster
4,656,747 A 4/1987 Troncoso
4,833,786 A 5/1989 Shores
5,004,332 A 4/1991 Edwards
5,093,837 A 3/1992 Edwards
5,121,251 A * 6/1992 Edwards ..... G02B 21/00 359/368
5,225,931 A 7/1993 Stavroudis
5,347,976 A 9/1994 Saunders
5,367,780 A * 11/1994 Savage ..... F41G 1/467 124/87
5,371,369 A 12/1994 Kent
5,669,146 A 9/1997 Beutler
5,697,357 A 12/1997 Chipman
5,697,358 A 12/1997 Chapman
5,860,408 A 1/1999 Summers
6,024,458 A 2/2000 Lundgren
6,058,921 A 5/2000 Lawrence
6,170,164 B1 1/2001 Knowles
6,239,922 B1 5/2001 Nakamura
6,282,800 B1 9/2001 Beutler
6,360,473 B1 3/2002 Merchant
7,047,652 B1 5/2006 Chipman
7,266,896 B1 9/2007 White
7,286,295 B1 10/2007 Sweatt et al.
7,373,723 B1 5/2008 Tupper, Jr.
7,543,389 B2 6/2009 Grace, Jr.
7,698,824 B2 4/2010 Wilson
7,762,677 B2 7/2010 Lundgren
7,975,391 B1 * 7/2011 Gillingham ..... F41G 1/467 124/87
8,000,010 B2 8/2011 Crandall
8,125,628 B1 2/2012 Lones
8,191,544 B2 6/2012 Buck
8,453,336 B2 6/2013 LoRocco
8,544,180 B2 10/2013 Minica
8,544,457 B1 * 10/2013 Munsell ..... F41B 5/143 124/44.5
9,829,278 B2 * 11/2017 Wolf ..... F41B 5/1419
9,921,033 B2 * 3/2018 Johnson ..... F41G 1/08
2005/0088748 A1 4/2005 Otteman
2007/0050998 A1 3/2007 Myers
2008/0066328 A1 3/2008 Bohn
2009/0007445 A1 1/2009 Bach
2011/0186028 A1 8/2011 VandeWater
2012/0180329 A1 * 7/2012 Priebe ..... F41G 1/01 33/265
2015/0338190 A1 11/2015 Johnson
2018/0080737 A1 * 3/2018 Gohlke ..... F41B 5/12

* cited by examiner

SHOOTING SPORTS SIGHT APPARATUS

PRIORITY CLAIM

This application is a continuation-in-part (CIP) of U.S. patent application Ser. No. 15/079,076 filed Mar. 24, 2016 and titled "Shooting Sports Sight Apparatus" of Andrew W. Munsell, et al. which claims the benefit of priority of pending U.S. Provisional Patent Application Ser. No. 62/142,680 filed Apr. 3, 2015 and titled "Archery Peep Sight" of Andrew W. Munsell, et al., hereby incorporated by reference in its entirety as though fully set forth herein.

BACKGROUND

Archers have always looked for ways to further increase the accuracy of the archery system (bow, arrows, string, arrow rest, sight aides, stabilizers and operator). Specific to peep apertures, very few improvements address unwanted light entering the main field of view. In the shooting sports (archery, firearms, etc.), lighting conditions change whether indoors or outdoors. Stray light, if not managed correctly, will cause the point of impact of the projective to move left, right, up or down depending on the lighting environment and conditions. For example, in outdoor lighting conditions, as the sun changes angle stray light changes its angle into the sighting system which ultimately causes accuracy to suffer. By eliminating the stray light contribution to the scene image, the sighting system is more accurate in relaying the true image scene.

DETAILED DESCRIPTION

Figure 1:
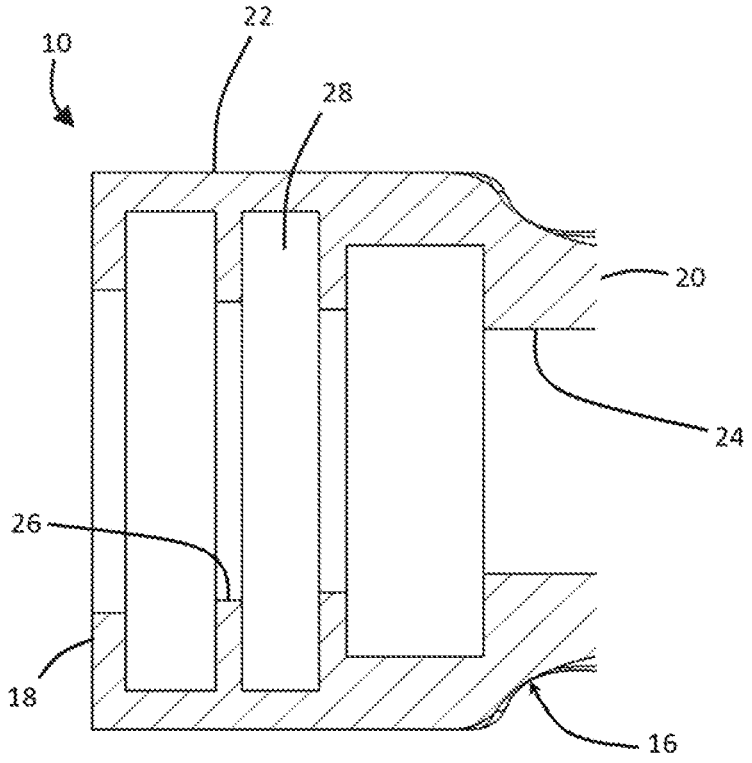
FIG. 1 is sectional side view illustrating a shooting sports sight apparatus.

A shooting sports sight apparatus is disclosed. In an example, the shooting sports sight apparatus has a series of concentric rings are spaced at discrete intervals to prevent unwanted stray light (e.g. glare) from entering into the chief rays of the line of sight (LOS) making up the observable scene where the final light baffle is interchangeable by the operator for optimizing the aiming sight picture.

In an example, the shooting sports sight apparatus may be implemented to inhibit unwanted stray light photons from entering into chief rays of a line of sight (LOS) making up an observable scene with an interchangeable final light baffle field stop. The sight apparatus comprises a sight housing having a first end, a second end substantially opposite the first end, an outer surface, and an inner surface. At least one concentric ring is positioned between the first end and the second end of the sight housing. At least one annular groove is defined between the first end of the sight housing and the at least one concentric ring. At least one concentric ring provides a surface for stray light photons entering the first end of the sight housing to bounce in directions generally away from the line of sight into the at least one annular groove thereby inhibiting the stray light photons from entering field of view photons reaching the second end of the sight housing which make up the observable scene.

In addition, a method is disclosed for inhibiting unwanted stray light photons from entering into chief rays of a line of sight (LOS) making up an observable scene. The method comprises providing a sight housing having a first end, a second end substantially opposite the first end, an outer surface, and an inner surface with the first end of the sight housing having a first diameter and the second end of the sight housing having a second diameter, positioning at least one concentric ring between the first end and the second end of the sight housing with the at least one concentric ring having a ring diameter, forming the first diameter of the first end of the sight housing greater than the ring diameter of the at least one concentric ring, forming the ring diameter of the at least one concentric ring greater than the second diameter of the second end of the sight housing, and providing a surface for stray light photons to bounce in directions generally away from the line of sight thereby inhibiting the stray light photons from entering field of view photons which make up the observable scene.

The example shooting sports sight apparatus may be implemented to inhibit unwanted stray light photons from entering into chief rays of a line of sight (LOS) making up an observable scene. The shooting sports sight apparatus comprises a sight housing having a first end, a second end substantially opposite the first end, an outer surface, and an inner surface with the first end of the sight housing having a first diameter and the second end of the sight housing having a second diameter. A plurality of concentric rings are spaced with decreasing through-hole diameters at intervals from the first end to the second end of the sight housing. The first diameter of the first end of the sight housing is greater than a diameter of the concentric ring closest to the first end and the plurality of concentric rings provides surfaces for stray light photons to bounce in directions not glancing to the LOS thereby inhibiting the stray light photons from entering field of view photons which make up the observable scene.

A plurality of interchangeable end baffle inserts may have varying exit aperture sizes for optimizing the sight picture when viewed with a from aperture apparatus for an open sight aiming system.

Before continuing, it is noted that the examples described herein are provided for purposes of illustration, and are not intended to be limiting. Other devices and/or device configurations may be utilized to carry out the operations described herein. The operations shown and described herein are provided to illustrate example implementations. It is noted that the operations are not limited to the ordering shown. Still other operations may also be implemented.

It is also noted that as used herein, the terms "includes" and "including" mean, but is not limited to, "includes" or "including" and "includes at least" or "including at least." The term "based on" means "based on" and "based at least in part on."

As illustrated in FIGS. 1-18, the example shooting sports sight apparatus, indicated generally at 10, may inhibit unwanted stray light (e.g. glare) from entering into the chief rays of the line of sight (LOS) 14 making up the observable scene where the last baffle is interchanged by threading or other means. While the shooting sports sight apparatus 10 will be described an illustrated as being a peep sight on an archery system 12, it is within the scope of the disclosure of the shooting sports sight apparatus 10 to be implemented for any type of peep sight, especially those sights implemented in shooting sports, i.e., archery systems 14 (both peep and forward sight), crossbow, firearms, i.e. rifle or pistol, shotgun, binoculars, spotting scopes, etc.

Figure 2:
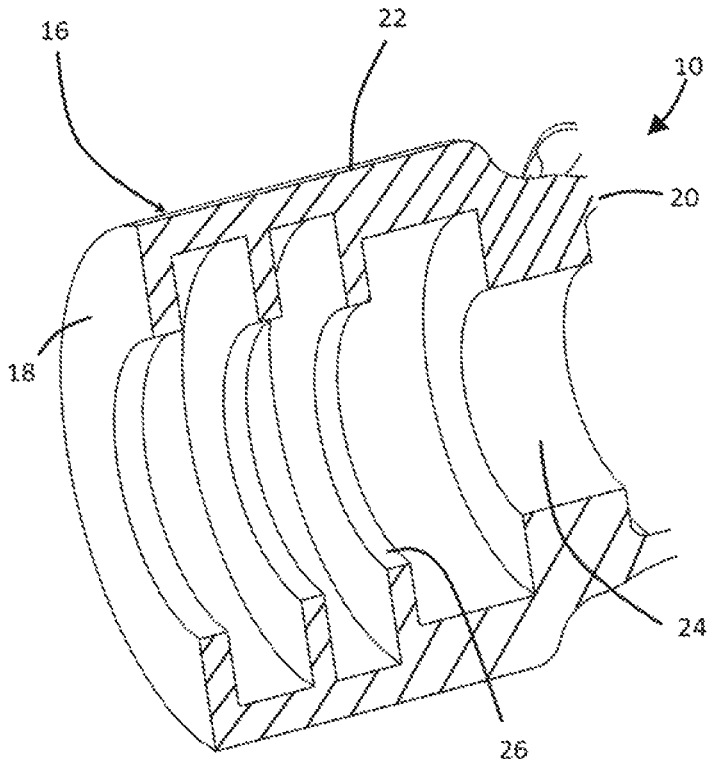
FIG. 2 is a sectional perspective view illustrating the shooting sports sight apparatus.
Figure 3:
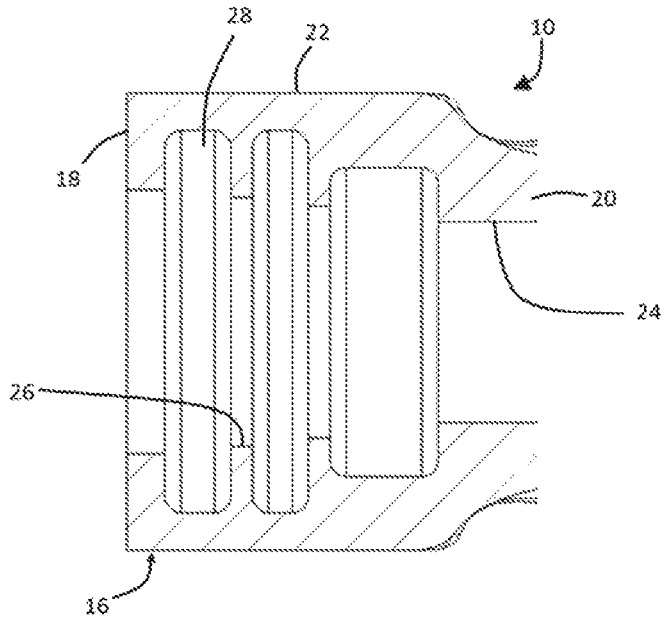
FIG. 3 is a sectional side view illustrating another example of the shooting sports sight apparatus.

As illustrated in FIGS. 1-3, the shooting sports sight apparatus 10 includes a housing 16 having a first end 18 and a second end 20 substantially opposite the first end 18. The sight housing 16 further has an outer surface 22 and an inner surface 24. The shooting sports sight apparatus 10 further includes at least one concentric ring 26 formed between the first end 18 and the second end 20 of the sight housing 16. In an example, the shooting sports sight apparatus 10 has a series of concentric rings 26 spaced with decreasing through-hole diameters at discrete intervals between the first end 18 and the second end 20 of the sight housing 16. In an example, an inner diameter of the concentric rings 26 extend beyond the inner surface 24 of the sight housing and inhibit unwanted stray light (e.g. glare) from entering into the chief rays of the line of sight (LOS) 14 making up the observable scene. In an example, the concentric rings 26 eliminate stray light from entering the main image scene by introducing concentric vertical rings 26 in the sight housing.

The concentric rings 26 within the sight housing 16 of the shooting sports sight apparatus 10 can be formed in numerous ways. In an example, each concentric ring 16 can be formed by forming an annular groove 28 in the inner surface of the sight housing. The annular groove 28 can have straight edges, as best illustrated in FIGS. 1 and 2, or beveled edges, as best illustrated in FIG. 3. With the concentric rings 26 being formed by annular grooves 28, the inner surface 24 of the sight housing 16 has sequentially decreasing diameter between the annular grooves 28 from the first end 18 of the sight housing 16 in a direction toward the second end 20 of the sight housing 16.

It should be noted that the annular grooves 28 of the shooting sports sight apparatus 10 can span the entire area between adjacent concentric rings 26 or can only partially span the area between adjacent concentric rings 26. In the latter, the annular groove 28 may be positioned directly adjacent the adjacent concentric ring 26 closest to the second end 20 of the sight housing 12 to allow direct absorption of the light photons, as will be described in further detail below.

In another example of the shooting sports sight apparatus 10, the concentric rings 26 can be created by forming the annular rings 26 during manufacture of the sight housing 16 or mounting annular rings 26 to the inner surface 24 of the sight housing 16. In an example, the annular rings 26 have decreasing through-hole diameters spaced at discrete, predetermined intervals from the first end 18 to the second end 20 of the sight housing 16. Mounting of the annular rings 26 can be accomplished by any type of mount including, but not limited to, adhesive, welding, screws, rivets, fasteners, friction, releasably locking each annular ring 26 within a corresponding annular groove, etc.

Like other shooting sports, in archery systems 12, the shooting sports sight apparatus 10 manages photon noise terms most commonly observed as photos enter into an open sighting system. The archery sighting system 12 can consist of an open aiming system. An archery peep 32 may be implemented when the bow is at full draw to sight with the front sight apparatus 30 by co-aligning the circular shapes of the forward and aft apparatuses after which time the forward apparatus integrated aiming reticule 41 is located on the target; followed by the firing or launching of the projectile 60 (bullet or arrow).

Figure 4:
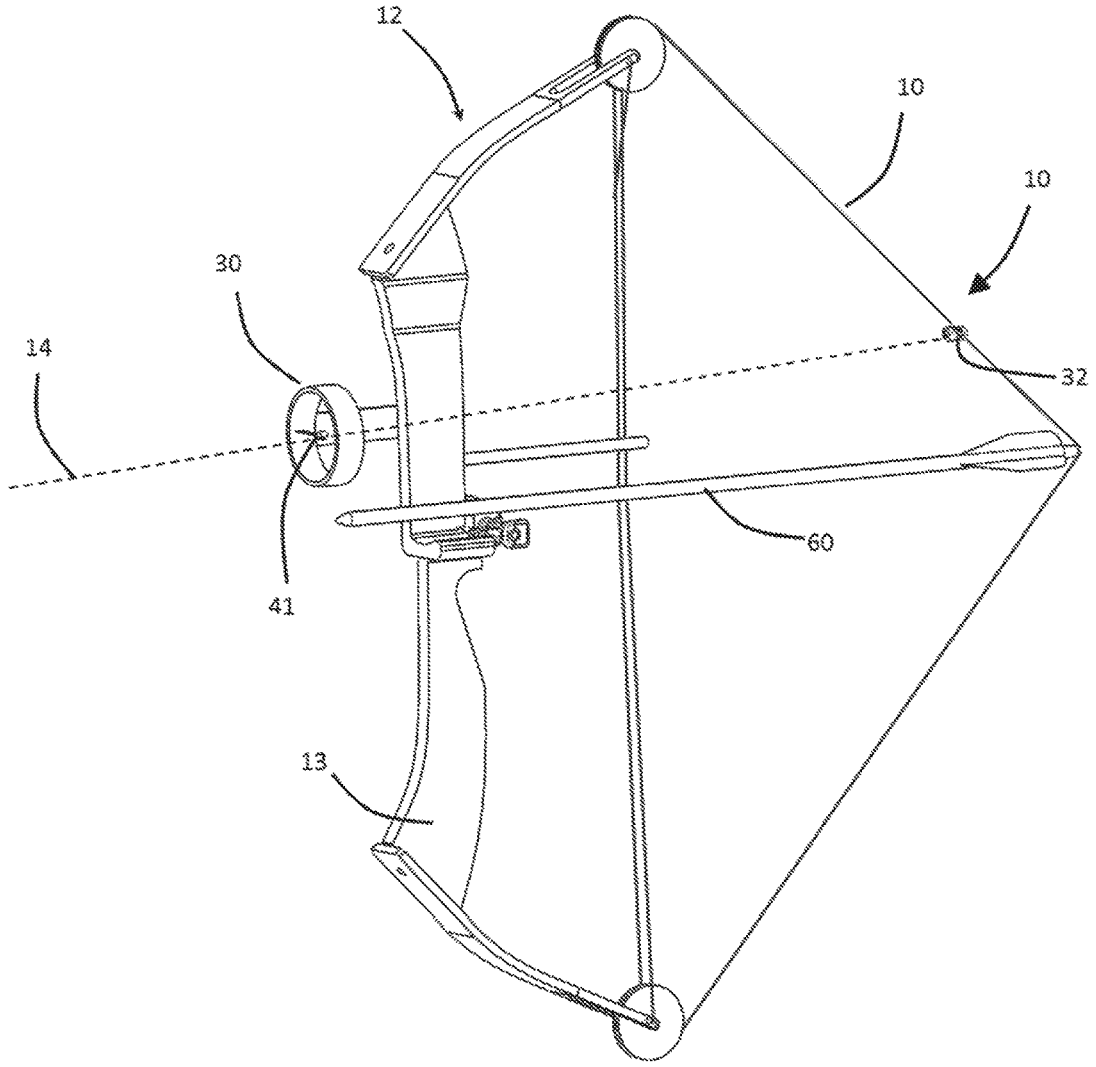
FIG. 4 is a perspective view illustrating the shooting sports sight apparatus as it may be mounted in an archery system.
Figure 5A:
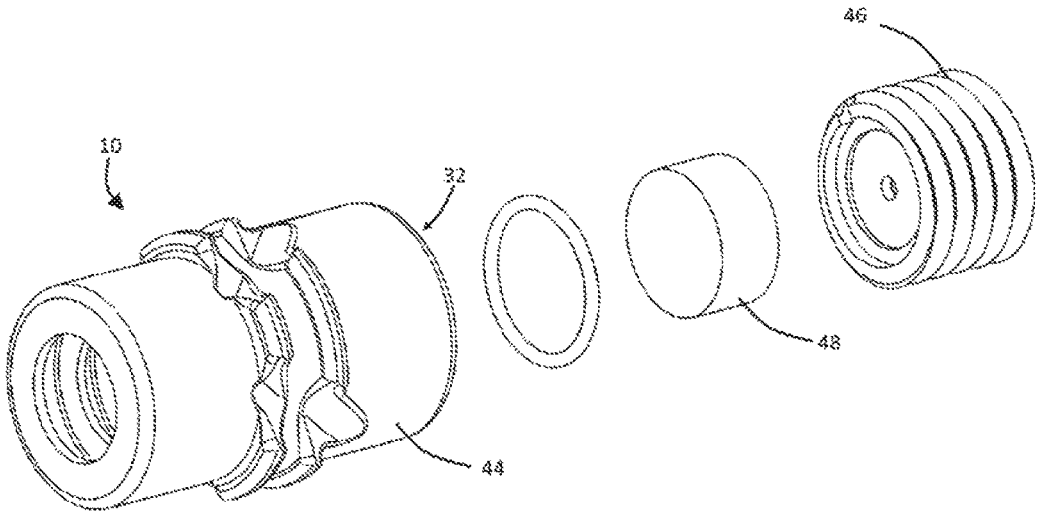
FIG. 5*a* is an exploded perspective view illustrating an archery peep sight of the shooting sports sight apparatus as it may include an O-ring with a threaded interchangeable final baffle and optical lens.
Figure 5B:
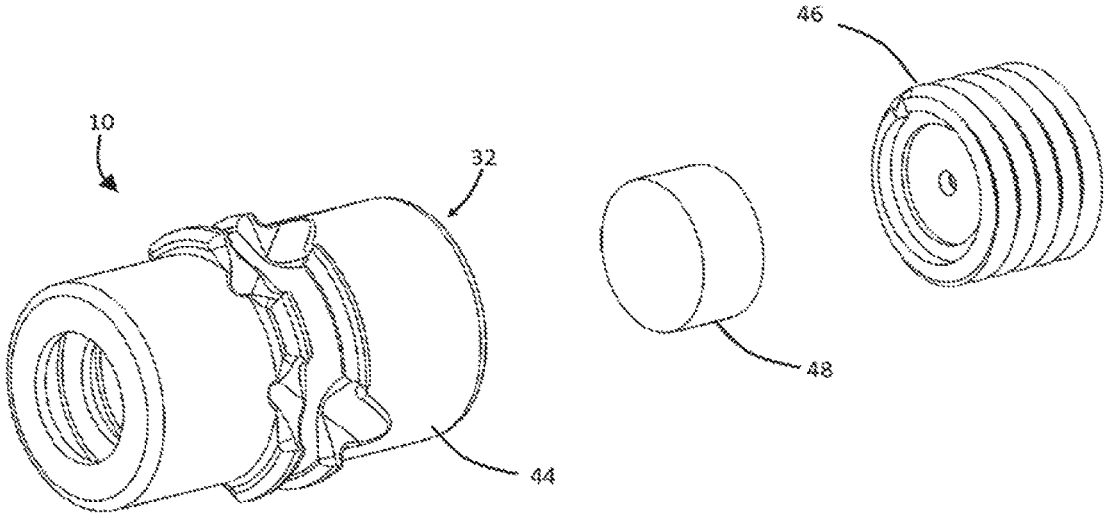
FIG. 5*b* is an exploded perspective view illustrating another example of the archery peep sight of the shooting sports sight apparatus without the O-ring with a threaded interchangeable final baffle and optical lens.
Figure 6:
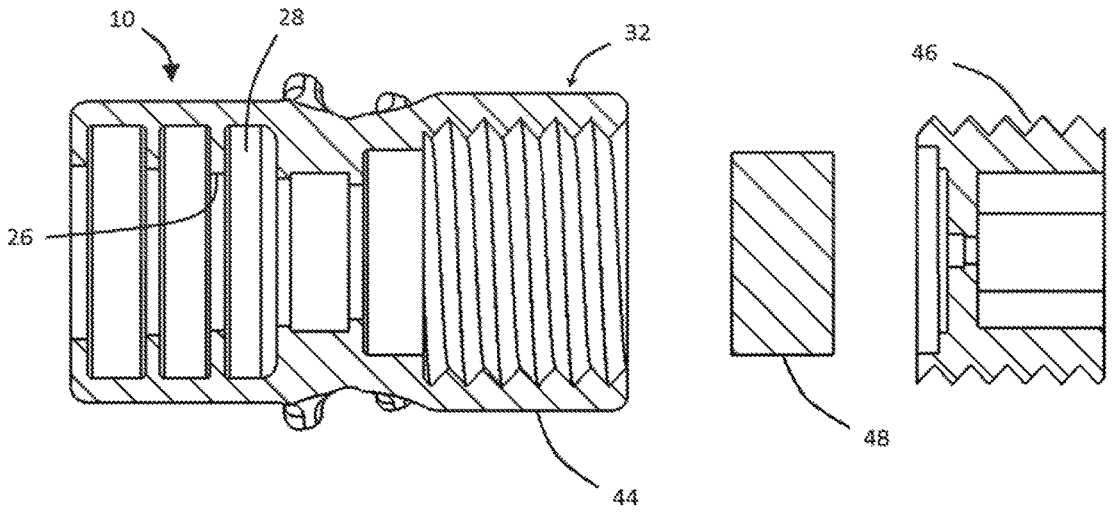
FIG. 6 is an exploded sectional side view illustrating the archery peep sight of the shooting sports sight apparatus of FIG. 5*b*.
Figure 7:
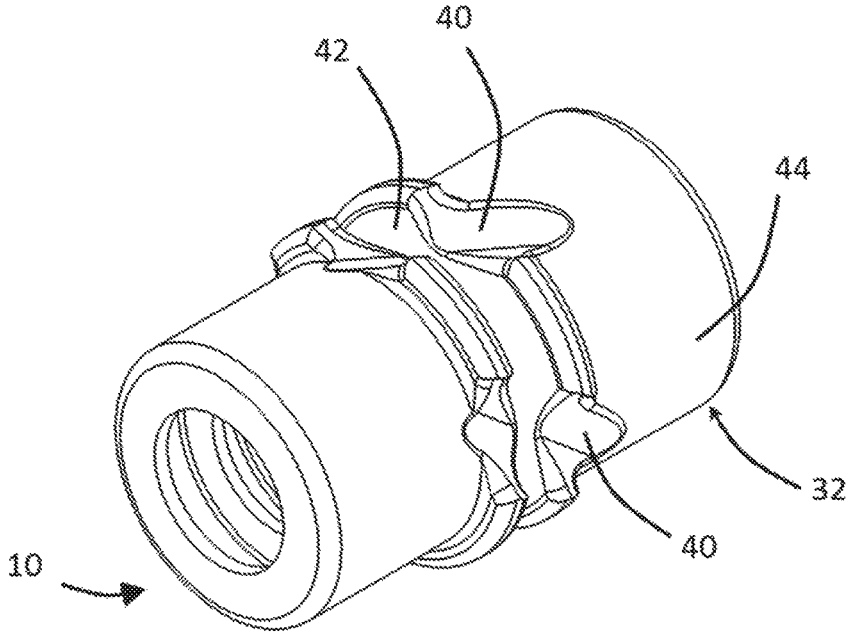
FIG. 7 is a perspective view illustrating the archery peep sight of the shooting sports sight apparatus.
Figure 8:
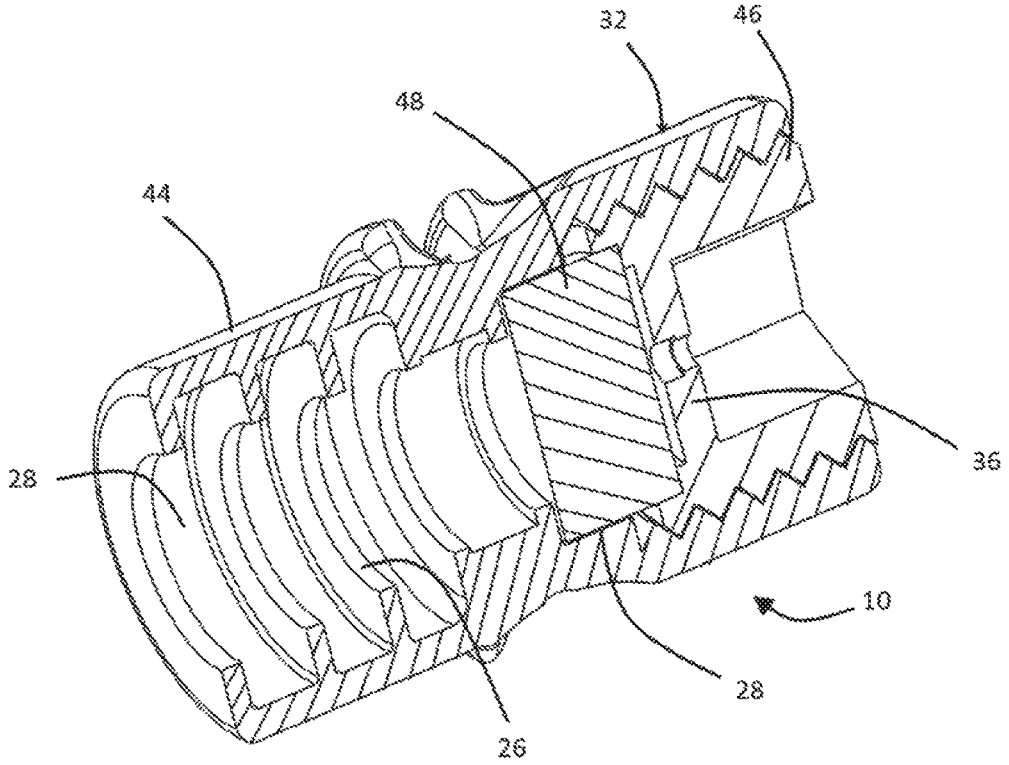
FIG. 8 is a sectional perspective view illustrating the archery peep sight of the shooting sports sight apparatus.
Figure 9:
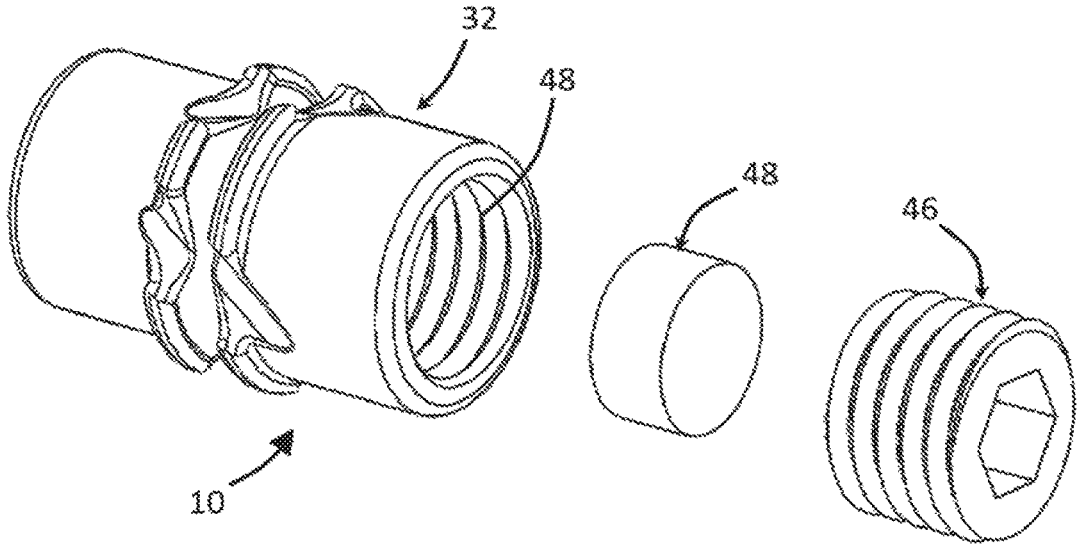
FIG. 9 is an exploded perspective view illustrating another example of the archery peep sight of the shooting sports sight apparatus.
Figure 10:
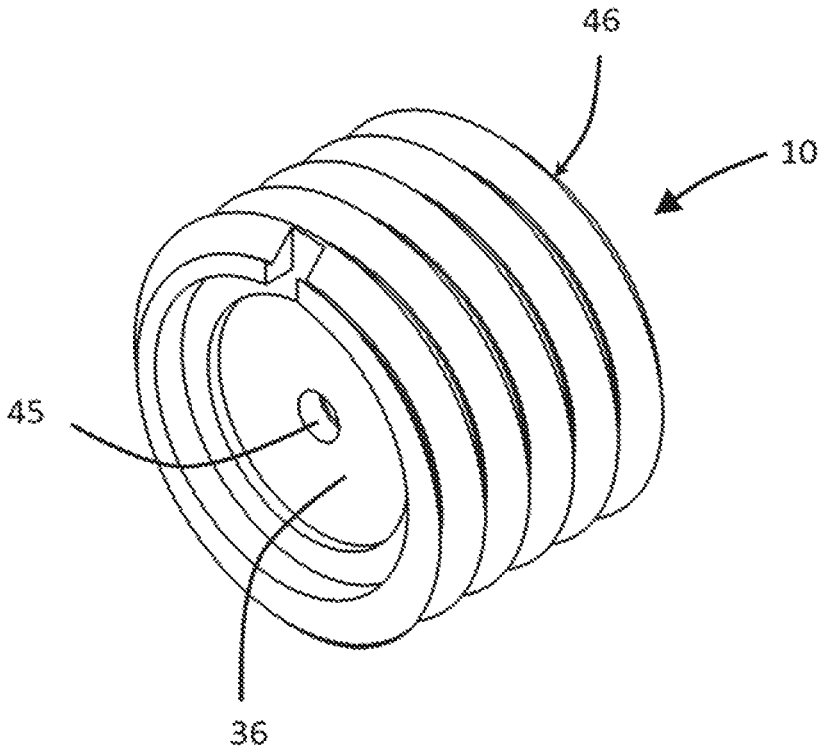
FIG. 10 is a perspective view illustrating a rear aperture threaded baffle insert of the archery peep sight of the shooting sports sight apparatus.

As illustrated in FIG. 4, typically in archery sports systems 12, the optical system is comprised of a forward sight 30 with or without an optic(s) and rear peep aiming device 32 with or without optic(s) that is mounted on or a part of a bow where on either end of the optical system or at both ends of the optical system. In an example, as illustrated in FIGS. 5-15, the peep sight housing 32 includes two separate complimentary pairs of grooves 40 on the outer surface 22 to accommodate two separate string angles for mounting the sight housing 16 into a bow string. The sight housing 16 may also have a concentric groove formed 42 on the outer surface 22 for allowing the sight housing 16 to be secured in the bow string. In addition, the second end 20 of the sight housing 16 has a peep housing 44 secured thereto. The peep housing 44 has a rear aperture being threaded to receive a threaded light baffle insert 46 of varying aperture sizes forming the final light baffle vane 26.

For an archery peep sight 32, the shooting sports sight apparatus 10 includes the sight housing 16 having the stray light managing concentric rings 26, the peep housing 44 mounted to the second end 20 of the sight housing 16, an interchangeable lens 48 for image clarity and magnification, and an aft screw-in baffle specific insert 46 receivable in the peep housing 44. The insert 46 captures the lens 48 within the sight body 12 providing provisions to center and capture the lens 48 and has a feature for a tool for screwing it in to the peep housing 44. The lens 48 can be part of the optical system or can be removed as an option and the shooting sports sight apparatus 10 in the archery situation can take advantage of the lens or not as determined by the user.

Figure 15:
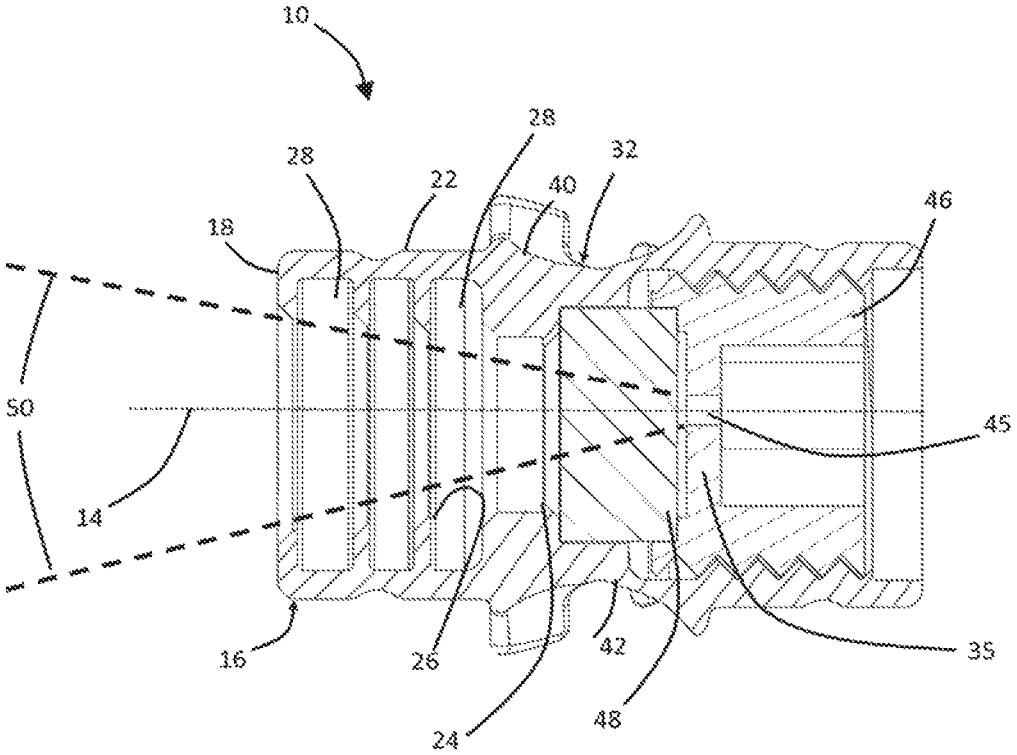
FIG. 15 is a sectional view illustrating the archery peep sight of the shooting sports sight apparatus of FIG. 14, showing the relationship of the interchangeable baffle with a small aperture size and the relationship to the field of view of the apparatus.
Figure 16:
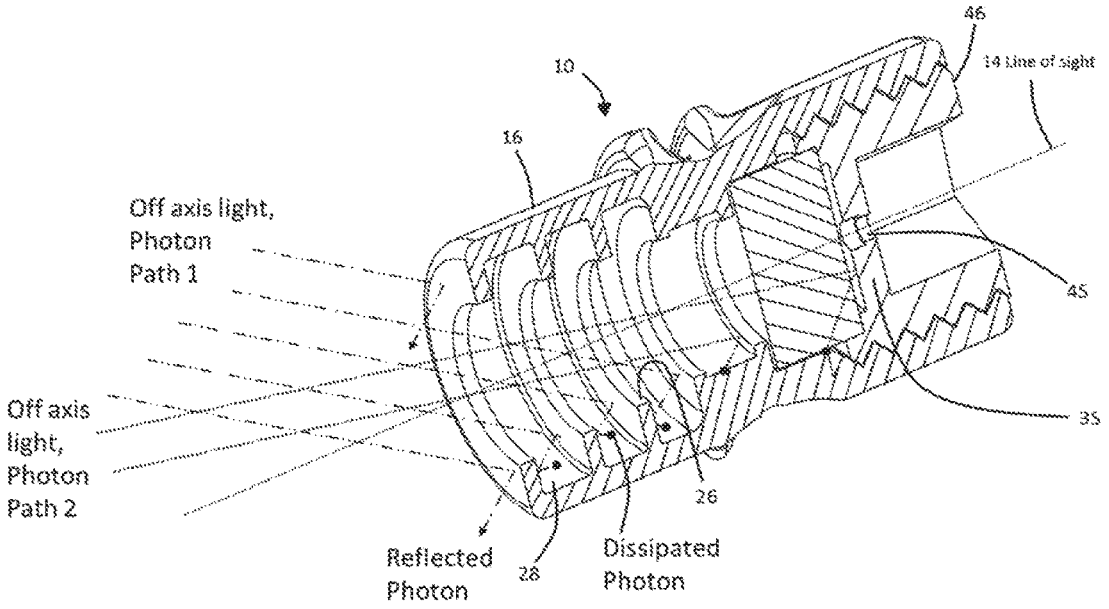
FIG. 16 is a sectional perspective view illustrating the reflection and dissipation of photons with the shooting sports sight apparatus baffles.

FIG. 15 shows how each concentric ring 26 diameter gets smaller from the first ring (front) to the last ring 36 with the smallest aperture 45 as part of the insert 46. This reduction in ring aperture diameter size from front to back sets the field of view 50 of the baffle assembly. Again, with the last interchangeable baffle 36 aperture 45 being the smallest as part of the insert 46.

In practice, the shooting sports sight apparatus 10 relates to a sighting system with or without optics where the image scene is not contaminated with off axis light. The off axis light also known as stray light as modeled as a point source at off angles in 2 pi-sterradian to the line of sight (LOS). This stray light (i.e. glare) is eliminated by the series of fixed concentric rings 26 spaced apart between the first end 18 and the second end 20 of the sight housing 16 in the LOS direction. The concentric rings 26, or baffle vanes as they are sometimes referred to in the optics industry, mitigate stray light by two main mechanisms. The concentric rings 26 present surfaces for stray light photons to bounce in directions not glancing to the LOS including into the grooves 28 where they are absorbed. This, in turn, eliminates these photons from entering field of view photons; the photon that make up the image scene of interest (i.e. observable scene). If the noise photons were allowed to enter the chief ray in an aiming or magnifying telescopic system, the viewed image would be distorted. Light noise sources come from all angles as a result of many sources to include glare as a result of light sources reflecting off surfaces external to the optical system and glare generated within the optical system due to smooth surfaces. The bright source illumination, from the sun or other nearby bright sources, is not only blocked from hitting the smooth, FIG. 16, and mostly specular inner tube of the shooting sports sight apparatus 10, but also the view from the user's eye is blocked from seeing the glare of the illuminated tube. Any light that does manage to reach the viewer's eye has been significantly attenuated due to the geometric requirement that any light getting to the user's eye has to bounce at least twice before continuing on to the entrance pupil. Any sighting optical device that does not have baffle vanes allows the bright source illumination photon (i.e. stray light) to enter the forward end and bounce through the structure. In some cases conditions can be such that the tube acts like a photon waveguide and amplifies the stray light, viewed as glare or blooming. By having the concentric rings 26, stray light is mitigated where the last baffle 36 aperture size 45 is interchangeable as integrated in the threaded insert 46 optimizing the light baffle angular field of view 50 set by the operator while simultaneously optimizing the co-alignment of the circular shapes of the forward sight apparatus 30 and the final interchangeable baffle aperture size 45 forming the sight picture field view 51.

Figure 14:
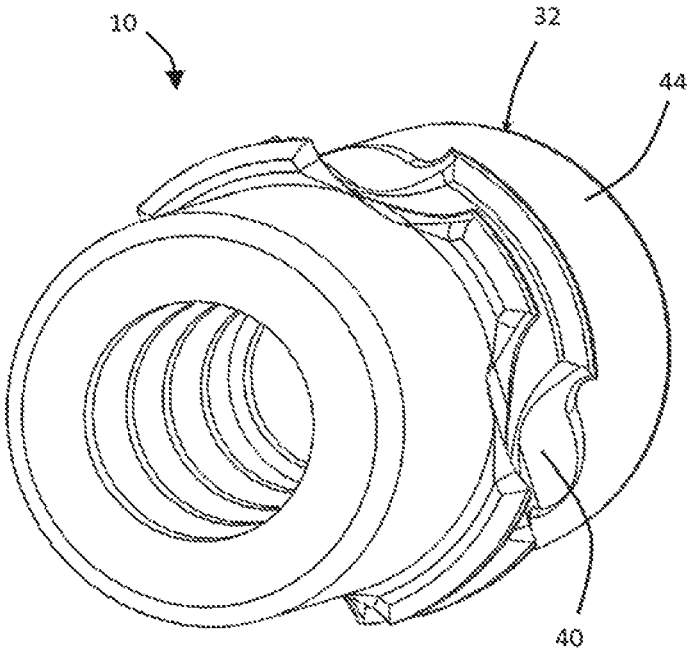
FIG. 14 is a perspective view illustrating another archery peep sight of the shooting sports sight apparatus.
Figure 17:
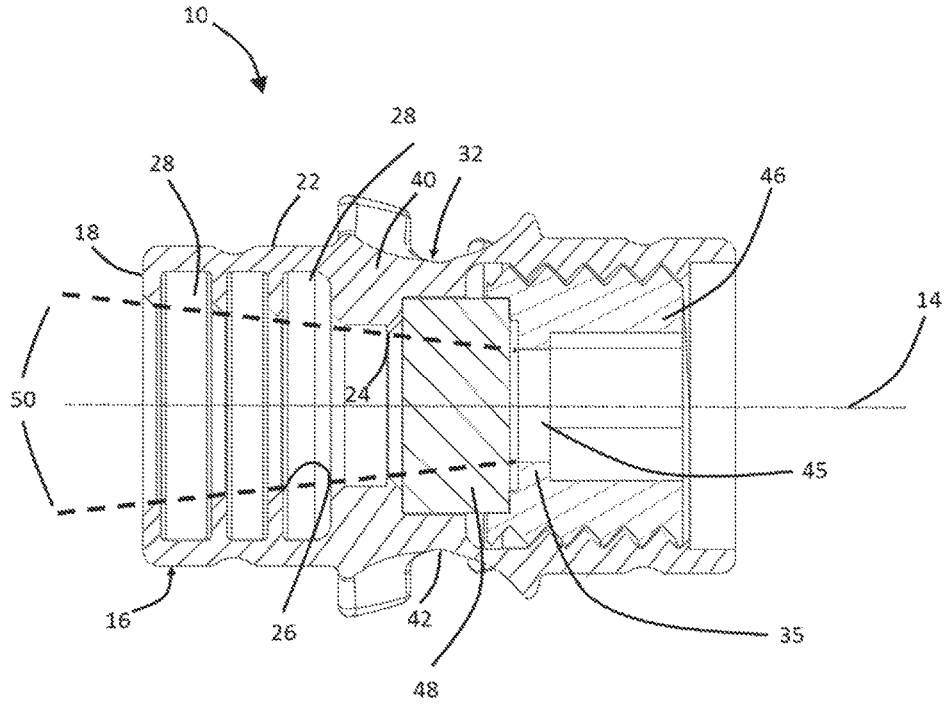
FIG. 17 is a sectional view illustrating the archery peep sight of the shooting sport sight apparatus of FIG. 14 showing the relationship of the interchangeable baffle with a large aperture size and the relationship to the field of view of the apparatus.
Figure 18:
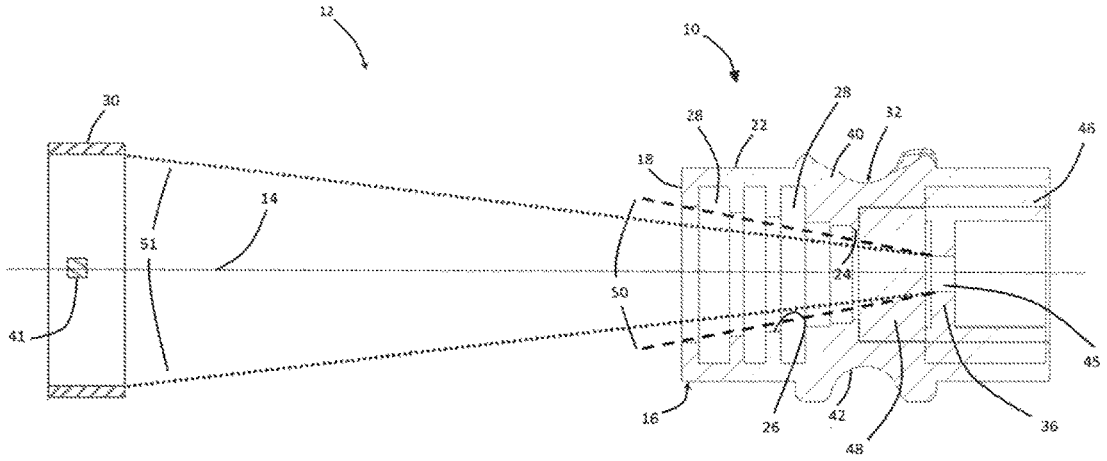
FIG. 18 is a sectional view illustrating the archery peep sight of the shooting sports sight apparatus as it may be mounted in an archery system of FIG. 4 and the relationship of the interchangeable final baffle to the field of view of the apparatus and the relationship of the final interchangeable baffle to the front sight apparatus.

FIG. 17 is a sectional view illustrating the archery peep sight 32 of the shooting sport sight apparatus of FIG. 14 showing the relationship of the interchangeable baffle insert 46 which incorporates the final baffle 36 with varying aperture size 45 and the relationship to the baffle field of view 50 of the apparatus. FIG. 18 is a sectional view illustrating the archery peep sight 32 of the shooting sports sight apparatus as it may be mounted in an archery system of FIG. 4 and the relationship of the interchangeable final baffle 35 and aperture 45 to the baffle field of view 50 of the apparatus and the relationship of the interchangeable baffle 35 and aperture 45 to the front sight apparatus field of view 51.

Figure 11:
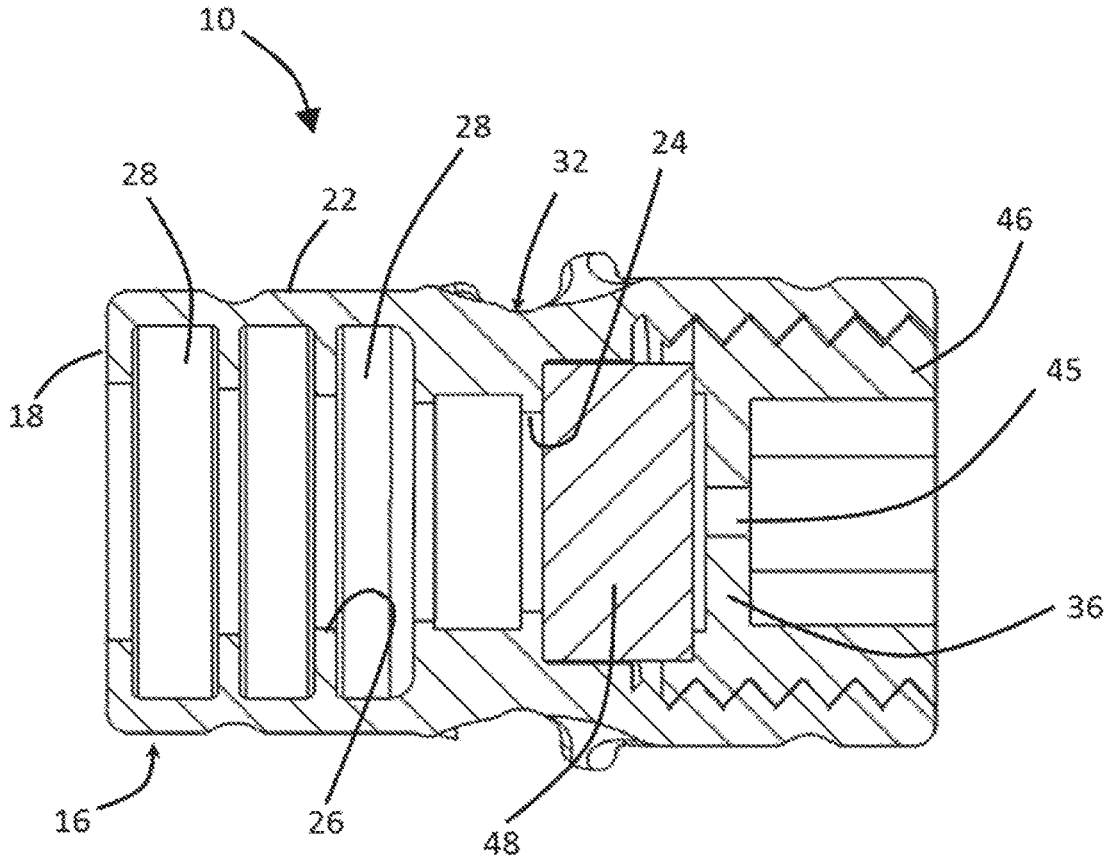
FIG. 11 is a sectional side view illustrating the archery peep sight of the shooting sports sight apparatus of FIG. 9.
Figure 12:
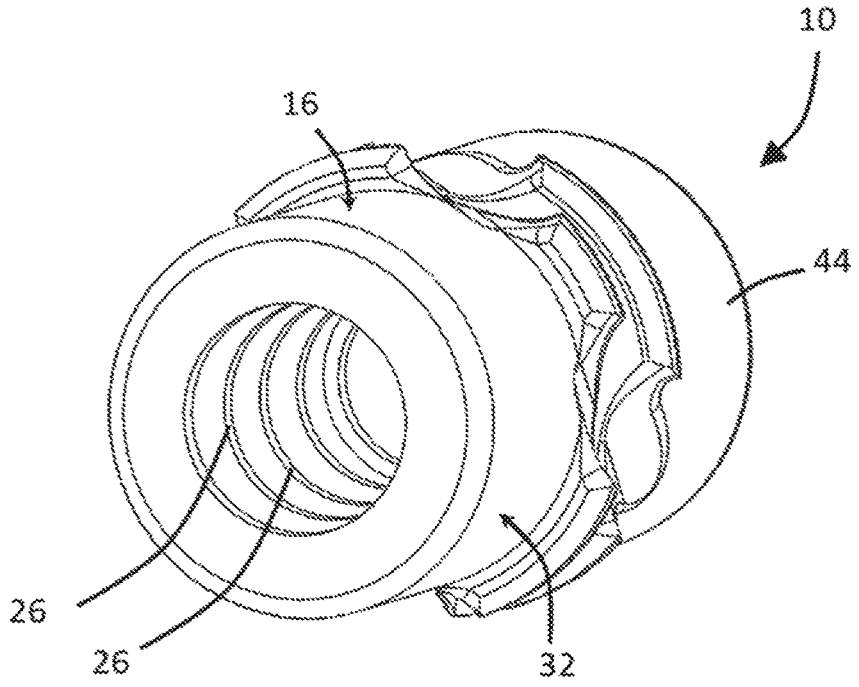
FIG. 12 is a perspective view illustrating the archery peep sight of the shooting sports sight apparatus of FIG. 9.
Figure 13:
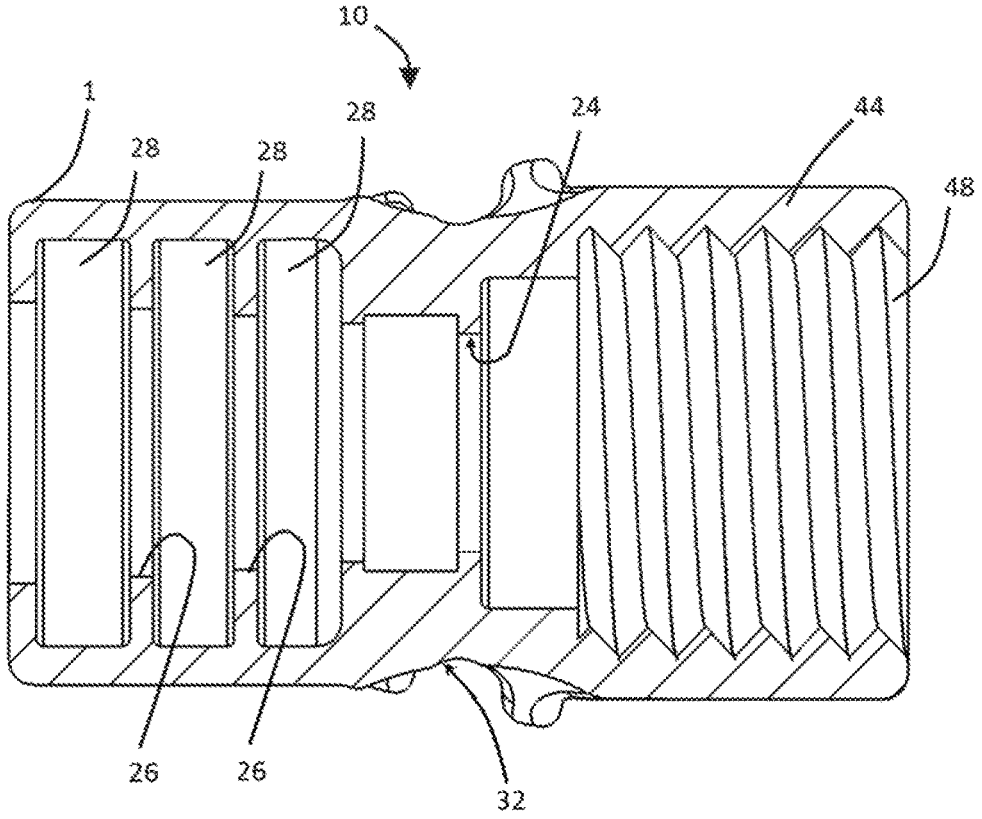
FIG. 13 is a sectional side view illustrating the archery peep sight of the shooting sports sight apparatus of FIG. 9.

It can be seen that the last baffle 35 and aperture size 45 are interchangeable in the peep sight 32 as part of the interchangeable insert 46 (FIG. 11). As such, a front sight 30 field of view 51 and light baffle angular field of view 50 can be simultaneously set by the operator (FIG. 18). That is, the outer diameter of the front sight 30 can vary from manufacturer to manufacturer necessitating the need to optimize the sight picture field of view 51 by the user. By changing the aperture size 45 of the final baffle 35 by means of interchanging the insert 46, the sight picture field of view 51 can be set. Since the peep sight 32 and the forward sight 30 are part of the open sighting system 12, and the baffles 26 are integral to the peep apparatus 32, by changing the aperture size 45 of the final baffle 35 by means of the interchangeable threaded insert 46, the user changes both the baffle field of view 50 (FIGS. 15 and 17) and the sight picture field of 51 simultaneously (FIG. 18).

The foregoing exemplary descriptions have been explained in the drawings and described in detail, with varying modifications and alternative examples being taught. While the example shooting sports sight apparatus has been so shown, described and illustrated, it should be understood by those skilled in the art that equivalent changes in form and detail may be made therein without departing from the true spirit and scope of the disclosure, and that the scope of the disclosure is to be limited only to the claims except as precluded by the prior art. Moreover, the example shooting sports sight apparatus as disclosed herein, may be suitably practiced in the absence of the specific elements which are disclosed herein.

The invention claimed is:

1. A shooting sports sight apparatus to inhibit unwanted stray light photons from entering into chief rays of a line of sight (LOS) making up an observable scene, the shooting sports sight apparatus comprising:

a sight housing having a first end, a second end substantially opposite the first end, an outer surface, and an inner surface;

at least one concentric ring positioned between the first end and the second end of the sight housing; and at least one annular groove defined between the first end of the sight housing and the at least one concentric ring;

wherein the at least one concentric ring provides a surface for stray light photons entering the first end of the sight housing to bounce in directions generally away from the line of sight into the at least one annular groove thereby inhibiting the stray light photons from entering field of view photons reaching the second end of the sight housing which make up the observable scene;

wherein a last baffle aperture size is interchangeable in the sight housing, thereby simultaneously setting a front sight and light baffle angular field of view set by the operator.

2. The shooting sports sight apparatus of claim 1 wherein the first end of the sight housing has a first diameter and the second end of the sight housing has a second diameter, additionally wherein the at least one concentric ring having a ring diameter, and further wherein the first diameter of the first end of the sight housing is greater than the ring diameter of the at least one concentric ring and the second diameter of the second end of the sight housing is less than the ring diameter of each of the at least one concentric ring and the first diameter of the first end of the sight housing.

3. The shooting sports sight apparatus of claim 2 wherein the at least one annular groove has a groove diameter greater than the first diameter.

4. The shooting sports sight apparatus of claim 1 wherein at least one annular groove has straight edges.

5. The shooting sports sight apparatus of claim 1 wherein the at least one annular groove has beveled edges.

6. The shooting sports sight apparatus of claim 1 wherein the at least one concentric ring is formed by mounting an annular ring to the inner surface of the sight housing.

7. The shooting sports sight apparatus of claim 1 and further comprising:

a plurality of concentric rings spaced with decreasing through-hole diameters at predetermined intervals from the first end to the second end of the sight housing; and a plurality of annular grooves defined in the inner surface of the sight apparatus;

wherein a single annular groove is defined between each pair of adjacent concentric rings.

8. The shooting sports sight apparatus of claim 7 wherein a diameter of the concentric ring closest to the first end is greater than a diameter of the next adjacent concentric ring.

9. The shooting sports sight apparatus of claim 8 wherein a diameter of the concentric ring closest to the second end is smaller than a diameter of the previously adjacent concentric ring.

10. The shooting sports sight apparatus of claim 7 wherein the plurality of concentric rings include a plurality of annular rings with decreasing through-hole diameters spaced at predetermined intervals mounted from the first end to the second end of the sight housing.

11. The shooting sports sight apparatus of claim 1 wherein the ring diameter of at least one concentric ring is greater than or equal to the second diameter of the second end of the sight housing.

12. The shooting sports sight apparatus of claim 1 and further comprising:

an archery peep sight comprising:

a peep housing mounted to the second end of the sight housing;

an aperture formed in the peep housing;

an interchangeable lens for image clarity and magnification receivable within the peep housing; and an aft screw-in aperture specific insert receivable in the aperture of the peep housing.

13. A method for inhibiting unwanted stray light photons from entering into chief rays of a line of sight (LOS) making up an observable scene, the method comprising:

providing a sight housing having a first end, a second end substantially opposite the first end, an outer surface, and an inner surface, the first end of the sight housing having a first diameter, the second end of the sight housing having a second diameter;

positioning at least one concentric ring between the first end and the second end of the sight housing, the at least one concentric ring having a ring diameter;

forming the ring diameter of the at least one concentric ring greater than the second diameter of the second end of the sight housing; and providing a surface for stray light photons to bounce in directions generally away from the line of sight thereby inhibiting the stray light photons from entering field of regard (FOR) photons which make up the observable scene;

wherein a last baffle aperture size is interchangeable in the sight housing, thereby simultaneously setting a front sight and a light baffle angular field of view set by the operator.

14. A shooting sports sight apparatus to inhibit unwanted stray light photons from entering into chief rays of a line of sight (LOS) making up an observable scene, the shooting sports sight apparatus comprising:

a sight housing having a first end, a second end substantially opposite the first end, an outer surface, and an inner surface; and a plurality of concentric rings spaced with decreasing through-hole diameters at intervals from the first end to the second end of the sight housing;

wherein the plurality of concentric rings provides surfaces for stray light photons to bounce in directions not glancing to the LOS thereby inhibiting the stray light photons from entering field of view photons which make up the observable scene;

wherein a last baffle aperture size is interchangeable in the sight housing, thereby optimizing a front sight and a light baffle angular field of view set by the operator.

15. The shooting sports sight apparatus of claim 14 and further comprising:

a plurality of grooves formed in the inner surface of the sight housing; and a plurality of inner surface areas formed on the inner surface of the sight housing defined between the grooves;

wherein the inner surfaces have decreasing through-hole diameters from the first end to the second end of the sight housing.

16. The shooting sports sight apparatus of claim 14 wherein the plurality of concentric rings are formed by mounting annular rings to the inner surface of the sight housing with decreasing through-hole diameters spaced at discrete, predetermined intervals mounted from the first end to the second end of the sight housing.

17. The shooting sports sight apparatus of claim 14 wherein a diameter of the concentric ring closest to the second end is greater than or equal to the second diameter of the second end of the sight housing.

18. The shooting sight apparatus of claim 17 where the second end has means for inserting the final baffle.

19. The shooting sight apparatus of claim 18 where the second end has means for changing the baffle aperture diameter forming the field of view formed by the baffle structure.

* * * * *